US005894069A

United States Patent [19]

Wen et al.

[11] Patent Number: 5,894,069

[45] Date of Patent: Apr. 13, 1999

[54] TRANSFERRING COLORANT FROM A DONOR ELEMENT TO A COMPACT DISC

[75] Inventors: Xin Wen, Rochester; Charles D. DeBoer, Palmyra; Alfred J. Amell, Spencerport, all of N.Y.

[73] Assignee: Eastman Kodak Company, Rochester, N.Y.

[21] Appl. No.: 08/798,082

[22] Filed: Feb. 21, 1997

[51] Int. Cl.[6] ..... B41M 5/035; B41M 5/38

[52] U.S. Cl. ..... 503/227; 428/64.4; 428/195; 428/913; 428/914; 430/945

[58] Field of Search ..... 8/471; 428/64.4, 428/195, 913, 914; 430/945; 503/227

[56] References Cited

U.S. PATENT DOCUMENTS

| | | | |
|---|---|---|---|
| 4,470,797 | 9/1984 | Harry et al. | 425/522 |
| 4,695,286 | 9/1987 | Vanler et al. | 8/471 |
| 4,772,582 | 9/1988 | DeBoer | 503/227 |
| 4,775,657 | 10/1988 | Harrison et al. | 503/227 |
| 4,876,235 | 10/1989 | DeBoer | 503/227 |
| 4,962,081 | 10/1990 | Harrison et al. | 503/227 |
| 4,973,572 | 11/1990 | DeBoer | 503/227 |
| 5,105,206 | 4/1992 | Sarraf et al. | 346/76 L |
| 5,244,861 | 9/1993 | Campbell et al. | 503/227 |
| 5,317,337 | 5/1994 | Ewaldt | 346/1.1 |
| 5,491,045 | 2/1996 | DeBoer et al. | 430/200 |
| 5,542,768 | 8/1996 | Rother et al. | 400/120.16 |
| 5,576,267 | 11/1996 | DeBoer et al. | 503/227 |

OTHER PUBLICATIONS

"Graphic Arts Manual," edited by Janet and Irving Field, Arno/Musarts Press, New York, N.Y., 1980, pp. 416–418.

*Primary Examiner*—Bruce H. Hess
*Attorney, Agent, or Firm*—Raymond L. Owens

[57] ABSTRACT

A method for transferring colorant from a donor element to a compact disc (CD) includes holding a CD in the focal plane of a focused laser beam with a colorant donor element being positioned in transferable relationship with the CD and focusing a laser beam on the colorant donor element to heat the donor element to a sufficient temperature to transfer colorant to the CD to thereby effect the transfer of colorant from the donor element to the CD.

6 Claims, 1 Drawing Sheet

TRANSFERRING COLORANT FROM A DONOR ELEMENT TO A COMPACT DISC

CROSS REFERENCE TO RELATED APPLICATIONS

Reference is made to commonly assigned U.S. patent application Ser. No. 08/779,695, filed Jan. 7, 1997, entitled "Printing Onto Discs Such As Compact Discs and the Like", to Wen et al and U.S. Pat. No. 5,797,688, filed Jan. 7, 1997, entitled "Thermal Dye Transfer Printing of Compact Discs Labels", to Wen assigned to the assignee of the present invention. The disclosure of these related applications is incorporated herein by reference.

FIELD OF THE INVENTION

The present invention relates to forming data records on a compact disc (CD).

BACKGROUND OF THE INVENTION

A compact disc (CD) is a high-volume and long lived data-storage medium. One recordable compact disc (CD-R) contains a polycarbonate disc that is coated with a dye layer, a metallized reflective layer, and a protective layer. A CD-R will be understood to be a compact disc that can be written on, typically by a laser beam as contrasted with a CD-ROM which information is recorded by injection molding. Cyanine, phthalocyanine, and metallized azo dyes are commonly used dyes coated in a polymer binder in the dye layer. The metallized reflective layer typically consists of gold in CD-R, and aluminum in CD-ROM. In a CD writer, a laser beam illuminates the dye polymers through the polycarbonate substrate as the disc spins. The illumination is turned on and off at selective locations determined by the input digital information. The heating by the laser causes the dye layer to chemically change at these locations, forming readable marks in the dye polymer. The degraded dye polymers in the marked regions are less reflective than the unmarked regions. During the reading process, a low-power laser scans the dye polymer layer in a recorded disc. The laser light is reflected directly from the unmarked regions, but is scattered or diminished in the marked regions. A sensor monitors the transitions between the marked and unmarked regions from the intensity of the reflective light, and converts it into a digital data stream. Similar to the above process, a CD-ROM differentiates the intensity of the reflective light by pits and lands in the compact discs. These pits and lands are prerecorded by pressing the compact discs, typically mass produced.

The CDs are often coated with a printable surface opposite to the surface from which the information is recorded and retrieved. On the printable surface, a label is printed which can be logos, trademarks, text, graphics, and bar codes, etc., which are related to the information stored on the CD. The label also protects the CD from physical damage. Because the CD spins at high speed in the writer and the player, the CD label needs to be precisely balanced to the center of the disc for smooth rotation.

Labeling of CD discs has routinely been accomplished through screen printing methods. While this method can provide a wide variety of label content, it tends to be cost ineffective for run lengths less than 300–400 discs because the fixed cost on unique materials and set-up are shared by all the discs in each run. The screen printing technique is well described in the textbook "Graphic Arts Manual", edited by Janet and Irving Field, Arno/Musarts Press, New York, N.Y., 1980, pp. 416 to 418. In screen printing a stencil of the image is prepared, placed in contact with the CD and then ink is spread by squeegee across the stencil surface. Where there are openings in the stencil the ink passes through to the surface of the CD, thus producing the image. Preparation of the stencil is an elaborate, time consuming and expensive process.

Recently, significant increases in use of CD-R discs as a data distribution vehicle have increased the need to provide customized CD label content to reflect the data content of the disc. For these applications, the screen label printing presents a dilemma as CD-R discs are designed to allow customized user information to be recorded in standardized CD formats.

Initially, the customized label information was "hand written" on the disc surface using felt tipped markers. While this method allowed users to individually identify discs, it tends to be labor intensive, prone to human error in transcription, and aesthetically limited.

Other attempts to provide a CD-R labeling solution has incorporated digitally printed adhesive labels. Label stock for this type of CD-R labeling is available from a number of sources. These allow pre-cut labels to be printed using desktop or commercial ink-jet, thermal wax transfer, or electrophotographic printers. An example of such labels is the STOMP Company's (Irvine, Calif.) CD Stomper package of die-cut CD labels that can be printed on any 8.5 by 11 inch inkjet or laser printer. Following printing, the labels can be applied manually with or without the aid of an alignment tool or a specially designed machine. This method can be labor intensive. It is also prone to human error in label transfer. Damage to the CD-R can result if the label is removed. System performance problems can occur due to disc imbalance or label delamination in the CD writer or reader.

U.S. Pat. No. 5,317,337 describes an apparatus and method for printing label information on a CD. Both ink jet and laser printing are described, but the laser printing is limited to printing ink onto an intermediate drum and then transferring the image to the CD label, that is, offset printing Within the past several years, methods for direct CD labeling have been growing in prominence. These methods utilize the versatility and ease of the setup associated with digital printing to provide customized label content directly on a disc surface. The most commonly used direct CD printers incorporate ink jet or thermal wax transfer technologies. Examples of such printers are the AFFEX Corporation's (2522 Chambers Road, Suite 110, Tustin, Calif.) Multi Media Color Ink Jet Printer, the FARGO Corporation's (Eden Prairie, Minn.) Signature CD Color Printer. These printers can be either stand alone or integrated into a computerized disc writing system reducing problems associated with labor, human error, disc damage, and imbalance. While printers of this type can produce satisfactory output, specially designed layers are required for their use. There is concern over performance of printed image quality for both types of printers. Thermal printing has demonstrated a lack of robustness with respect to abrasion and ink jet printing is less resistant to moisture. There are additional concerns over the inability to produce multi-color output on the thermal wax transfer CD-label printers, and the long print time required for the ink jet label printing. Additionally, both of these printers are binary in the density scale, and cannot reproduce continuous tone photographic images.

One known continuous-tone digital color printing technique is the thermal resistive dye diffusion (or sublimation)

printer. Printing techniques have been disclosed in U.S. Pat. No. 5,542,768, and the above cross referenced co-pending applications. However, a thermal resistive head (both thermal wax transfer and dye diffusion) prints at a pressure contact to the CD surface. Good printing uniformity by thermal resistive printing requires (see for example, U.S. Pat. No. 5,244,861) a conformable layer in the receiving paper, which is lacking in CD-R discs.

Screen printing is not economic for printing label images on a small number of discs. Ink-jet and thermal wax transfer printing methods are binary, and therefore not suitable for photographic quality continuous tone printing. Thermal resistive head printing techniques including wax transfer and thermal dye diffusion printing require either a conformable surface or a high pressure nip contact between the print head and the Photo CD surface, both of which make the process expensive and difficult. All the above techniques, to different degrees, are slow in printing speeds.

SUMMARY OF THE INVENTION

One object of this invention is to provide a method of printing high quality data records on a CD.

Another object of this invention is to provide an economical way of printing records on small numbers of CDs.

A still further object of this invention is to provide a laser thermal transfer arrangement which can readily transfer colored records to a polymer receiving layer formed on a CD.

A further object of the invention is to provide a CD which is adapted to record thermal images which are in a polymer image receiving layer and which are relatively permanent.

These object are achieved by a method for transferring colorant from a donor element to a compact disc (CD) comprising the steps of:

a) holding a CD in the focal plane of a focused laser beam with a colorant donor element being positioned in transferable relationship with the CD; and b) focusing a laser beam on the colorant donor element to heat the donor element to a sufficient temperature to transfer colorant to the CD to thereby effect the transfer of colorant from the donor element to the CD.

The CD on which a record image is desired is held in the focal plane of a focused high intensity laser beam while a color donor element sheet is held in intimate contact with the surface of the CD. The laser beam is moved relative to the surface of the CD, in effect, to raster scan the surface of the CD, and the laser beam is modulated in intensity from point to point in correspondence with a record image, thereby effecting laser thermal color transfer from the donor element to the CD in correspondence with the record image.

Advantages

The present invention provides high quality records which are permanent. A feature of the invention is that when dye is the transferable colorant, continuous tone images can be formed.

Another feature of the invention is that high resolution images (2400 pixel/inch vs. 300–600 pixel/inch can be formed which are continuous tone or bi-modal).

Another feature of the invention is that the record images can have improved uniformity since there is no pressure contact during image transfer.

A further feature of the invention is that by forming a colorant receiving layer on a compact disc, the record can be relatively permanent and not easily removed from the disc.

A further feature of the invention is that is provides an effective way of providing image records or labels on compact discs when relatively short-runs of the discs are produced.

A still further feature is that images can be produced by computers which are readily transferred to the compact disc.

DETAILED DESCRIPTION OF THE INVENTION

The present invention is described with relation to a compact disc which can include a CD-ROM and a CD-R, it will be understood that it also can be directly applied to newer forms of discs such as those called digital versatile discs or DVD. So when the term CD is used, it will be understood to include all of these types of discs. The term data as used throughout this specification will be understood to those skilled in the art to include digital data such as bar codes, analog data such as text, graphics such as line art, pictorial information such as colored images or combinations thereof and the like.

Figure 1:
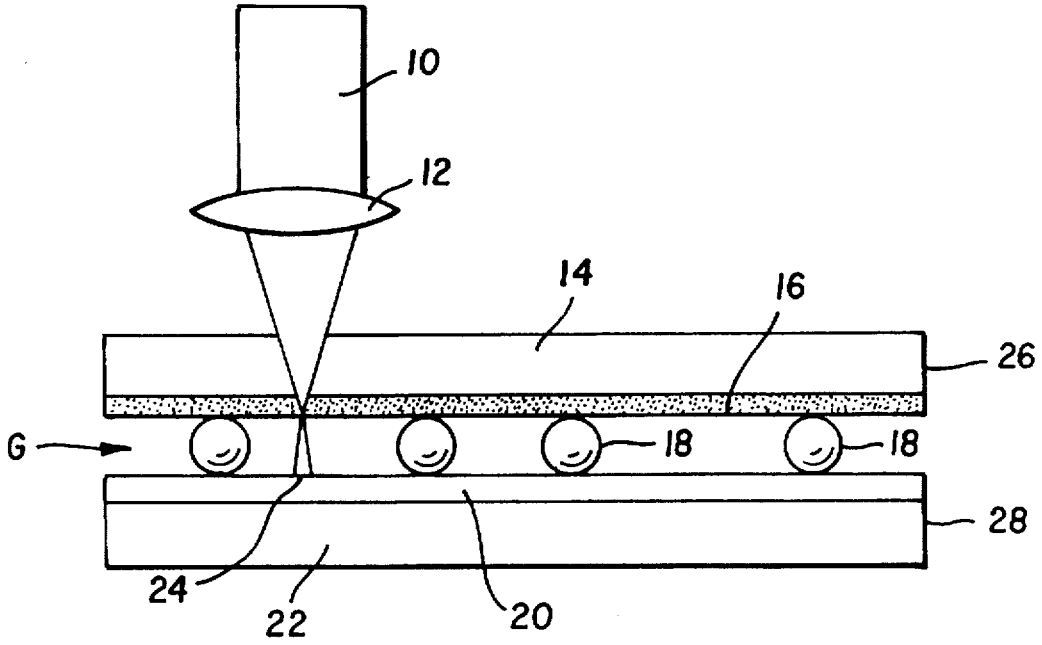
FIG. 1 is a partial schematic view showing an apparatus for printing records on CD discs using infrared laser thermal transfer wherein the CD is in transferable relationship with a colorant donor element.

Referring to FIG. 1, a diode laser beam 10 is shown being focused by a lens 12 through a transparent donor element support 14 onto a color layer 16 which contains a) an absorber for the laser beam to generate heat; b) a colorant to transfer to the disc record layer 20 which is coated on the disc support polymer 22 to produce a colored pixel of the desired image 24; c) a polymeric binder to hold the colorant in the layer. The heat generated by the absorption of the laser beam causes the colorant to evaporate, sublime, or ablatively transfer (24) from the donor element layer to the disc 28. Between the donor element and the disc are deposed spacer beads 18 to maintain a fixed gap "g" between the donor element 26 and the disc record layer 20. Throughout this specification, whenever the term colorant is used, it will be understood to includes dyes, pigments, or transferable materials which can form a dichroic filter or the like. After the first color is printed, the donor element is removed without disturbing the position of the disc, the second color donor element is placed in position, and the printing process is repeated with the second digital color record. Generally three color donor elements are required for a full color image; cyan, magenta and yellow, corresponding to the red, green and blue color separations of the digital image.

The colorants in the color layer can be chosen from a number of dyes or pigments. It is important that the colorant have a clean, strong hue, with good color saturation and little unwanted absorption in the optical region of the electromagnetic spectrum. The colorant should also have a low thermal mass, so the minimum amount of heating is required to cause the colorant to transfer from the donor element to the receiver. Throughout this specification, whenever the term "thermal mass" is used, it will be understood to mean the weight, or mass, of material that will be raised a given temperature by a given amount of energy (a given number of Joules). Exemplary dyes that can be use can be found in commonly assigned U.S. Pat. No. 5,576,267 to DeBoer et al, the disclosure of which is hereby incorporated by reference.

The polymeric binder for the colorant can be chosen from the common film forming thermoplastic polymers, such as cellulose acetate, cellulose acetate propionate, polyvinylbutyral, nitrocellulose, and the like. Exemplary binder polymers can be found in U.S. Pat. No. 5,491,045, the disclosure of which is hereby incorporated by reference.

The polymeric receiver layer 20 on the compact disc can be chosen from a number of film forming polymers such as polycarbonates, polyesters, and polyacrylates, for example. It should be noted that it is possible for the composition of the polymeric receiver layer to be the same as that of the disc polymer support 24, that is, the compact disc can be written on directly, without coating a separate layer 20. A different polymer may be chosen to optimize the performance of the compact disc. The polymeric receiver layer 20 may be coated over the entire surface of the compact disc, or may cover only a portion of the surface. The polymeric receiver layer 20 may contain addenda such as surfactants to aid in coating, or opacification agents such as titanium dioxide and the like to provide a white reflective surface. Exemplary polymers can be found in U.S. Pat. Nos. 4,695,286; 4,470,797; 4,775,657; and 4,962,081, the disclosures of which are hereby incorporated by reference. Factors dictating the proper choice of the receiver polymer layer are compatibility with the colorant, abrasion resistance, water and fade resistance of the image, cost and manufacturability. A proper choice of the polymeric receiver layer and the colorant will provide a relatively permanent record. The term "relatively permanent" as used throughout this specification will be understood to those skilled in the art to mean that labeled compact disc, in the normal course of use and storage will not undergo significant change over a period of many years.

The absorber can be a dye or a pigment. Ideally, the absorber should have high absorption for a given thermal mass, and should not transfer to the receiver in any significant way that might contaminate the colors of the image. Exemplary dyes that can be used as absorbers can be found in U.S. Pat. No. 4,973,572, the disclosure of which is hereby incorporated by reference.

The spacer beads 18 in FIG. 1 can be polymeric, crosslinked or not, inorganic materials such as sand, glass, or metal, as long as they are insoluble in the solvent or binder that they are coated in. The shape of the beads can be symmetric, such as spherical, or unsymmetric, provided the range of the average diameter is no more than 50% of the average diameter. The spacer beads can be located either in the receiver layer, as exemplified by U.S. Pat. No. 4,876,235 or in the donor element, as exemplified by U.S. Pat. No. 4,772,582, the disclosures of which are hereby incorporated by reference. The purpose of the beads is to provide spacing so that the gap "g" remains constant through the process of transferring colorant. The details of size, number and distribution of the beads are also given in the above references.

Figure 2:
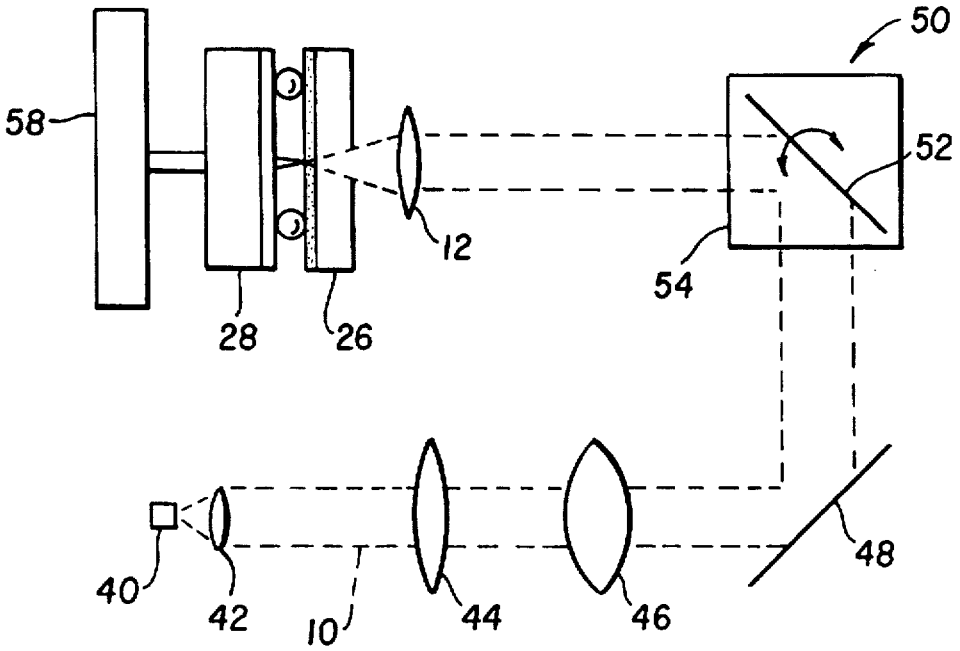
FIG. 2 is an apparatus showing an arrangement for scanning a laser beam across a record which is focused on a dye donor element for transfer of the record to a compact disc.

FIG. 2 shows a laser diode 40 which emits a beam 10 of laser light which passes through collimating lens 42, beam shaping lenses 44 and 46 and reflects off a fixed mirror 48. A galvanometer structure 50 includes a moving mirror 52 and a motor 54 which oscillates or nutates the beam of light which was reflected from the fixed mirror 48. The motor 54 controls the position of the moving mirror 52 so as to provide relative movement between the disc surface and the laser beam and modulating the laser beam in correspondence with a data record, thereby effecting laser thermal colorant transfer from the donor element to the compact disc in correspondence with a desired data record. The position of the laser beam is thereby controlled by the galvanometer structure 50. It will be noted that an F-theta lens 12 is provided between the compact disc surface and the moving mirror 52 and is adapted to focus the beam onto the donor element. The position of the moving mirror 52 controls the position of the laser spot in one direction, and a lead screw translation mechanism 58 moves the CD to control the relative position of the laser spot in an orthogonal direction opposite to that provided by the moving mirror 52. Other means of translation can also be employed, such as two galvanometers, or a linear motor to translate the compact disc. Although the figure shows a diode laser for illustration, other lasers can be used, such as gas lasers or solid state lasers. Other optical paths are also possible.

The laser beam can be focused to approximately the same size as the wavelength of light emitted by the laser. For a near infra-red laser this is a spot size of about one micron. This small size assures that a high quality photographic image can be printed. Modulation of the intensity of the beam allows many levels of color, from very light to very dark, to be printed at any given pixel of the image.

EXAMPLE

Cyan, magenta and yellow dye donor elements, as described in U.S. Pat. No. 4,973,572 were placed in contact with a compact disc that had been spin coated with a mixture of Butyvar B-76 (Monsanto), titanium dioxide (less than 5 micron particle size) and crosslinked polystyrene beds of 10 micron diameter size. The titanium dioxide level was twice that (by weight) of the butyvar. The bead level was 1% of the butyvar, and the butyvar was coated at about 1 micron thickness. The apparatus used to expose the dye donor element was that described in U.S. Pat. No. 5,105,206, and the laser power was 37 mW at the focal plane. After exposure to all three colors, a high quality photographic image was seen on the compact disc.

The invention has been described in detail with particular reference to certain preferred embodiments thereof, but it will be understood that variations and modifications can be effected within the spirit and scope of the invention.

Parts List

14 donor element support
16 color layer
18 spacer beads
20 disc record layer
22 disc polymer support
24 transferred color pixel
26 donor element
28 disc
40 laser diode
10 beam
42 lens
44 lens
46 lens
48 fixed mirror
50 galvanometer structure
52 moving mirror
54 motor
12 F-theta lens
58 translation mechanism

We claim:

1. A method for transferring colorant from a donor element to a compact disc (CD) to form a desired record, comprising the steps of:

a) holding a CD in the focal plane of a focused laser beam with a colorant donor element and spaced from the donor element at a predetermined distance from the donor element and being positioned in transferable relationship with the CD;

b) focusing a laser beam on the colorant donor element to heat the donor element to a sufficient temperature to transfer colorant to the CD to thereby effect the transfer of colorant from the donor element to the CD; and c) providing relative movement between the CD and the laser beam and modulating the laser beam in correspondence with a data record, thereby effecting laser thermal colorant transfer from the donor element to the compact disc in correspondence with a desired data record.

2. A method for transferring colorant from a donor element having a colorant layer with transferable colorant and a layer for absorbing infrared laser light to heat the colorant so as to transfer colorant to a compact disc (CD) to form a desired record comprising the steps of:

a) holding a CD in the focal plane of a focused laser beam with a colorant donor element and spaced from the donor element at a predetermined distance from the donor element by spacer beads and being positioned in transferable relationship with the CD;

b) focusing an infrared laser beam on the colorant donor element to cause the absorbing layer to heat the donor element to a sufficient temperature to transfer colorant to the CD to thereby effect the transfer of colorant from the donor element to the CD; and c) providing relative movement between the CD and the laser beam and modulating the laser beam in correspondence with a data record to thereby effecting laser thermal colorant transfer from the donor element to the compact disc in correspondence with a desired data record.

3. The method of claim 2 wherein the relative movement step is provided by scanning the infrared laser beam.

4. The method of claim 2 further including a polymer image receiving layer formed on a surface of the CD for receiving colorant from the donor element to form the desired data record.

5. The method of claim 4 further including positioning different donor elements, each with a different colorant in image transferable relationship with the CD to provide a color image.

6. The method of claim 4 wherein the colorant is a dye which is adapted to be transferred by sublimation to the image receiving layer.

* * * * *

UNITED STATES PATENT AND TRADEMARK OFFICE

CERTIFICATE OF CORRECTION

PATENT NO. : 5,894,069
DATED : April 13,1999
INVENTOR(S) : Xin Wen, et al

It is certified that error appears in the above-identified patent and that said Letters Patent is hereby corrected as shown below:

| | |
|---|---|
| On the title page, item [22] Filed: | "Feb. 21, 1997" should be deleted and substituted with --Feb. 12, 1997-- |

Signed and Sealed this

Twenty-fourth Day of August, 1999

*Attest:*

Q. TODD DICKINSON

*Attesting Officer*

*Acting Commissioner of Patents and Trademarks*